US006133536A

United States Patent [19]

Hunag et al.

[11] Patent Number: 6,133,536

[45] Date of Patent: Oct. 17, 2000

[54] KEY SWITCH ASSEMBLY

[75] Inventors: Jung-Kuo Hunag; Max Peng, both of Tu-Chen, Taiwan

[73] Assignee: Hon Hai Precision Ind. Co., Ltd., Taipei Hsien, Taiwan

[21] Appl. No.: 09/377,882

[22] Filed: Aug. 19, 1999

[30] Foreign Application Priority Data

May 11, 1999 [TW] Taiwan ..... 88207478

[51] Int. Cl.[7] ..... H01H 9/26

[52] U.S. Cl. ..... 200/5 A; 200/512

[58] Field of Search ..... 200/5 A, 406, 200/512

[56] References Cited

U.S. PATENT DOCUMENTS 5,898,147 4/1999 Domzalski et al. ..... 200/1 B

*Primary Examiner*—Michael L. Gellner
*Assistant Examiner*—Nhung Nguyen
*Attorney, Agent, or Firm*—Wei Te Chung

[57] ABSTRACT

A key switch assembly of the present invention comprises a housing, first and second contacts, and a metal dome. The housing forms an aperture inwardly recessed from a side surface thereof. The first and second contacts are partially received in the housing and include first and second contact portions, first and second mounting portions for being mounted on the circuit board, and first and second connecting portions respectively connected between the first and second contact portions and the first and second mounting portions. The metal dome is securely received in the aperture of the housing and includes a base and a mating portion extending from the base. The mating portion contacts the first contact portion of the first contact and the base contacts the second contact portion of the second contact when the metal dome is depressed.

9 Claims, 5 Drawing Sheets

KEY SWITCH ASSEMBLY

BACKGROUND OF THE INVENTION

The present invention relates to a key switch assembly, and especially to a key switch assembly which is easily assembled and which ensures input reliability.

A key switch assembly is one of the most common input devices of a computer or a telephone. Referring to FIGS. 1 and 2, a conventional key switch assembly includes a housing 100, and first and second contacts 102, 104 received in the housing 100. The first and second contacts 102, 104 each include mounting portions 106, 108 and contact portions 110, 112 perpendicularly extending from the mounting portions 106, 108. The mounting portions 106, 108 extend beyond the housing 100 to electrically connect with a printed circuit board 109. The contact portions 110, 112 are electrically connected by a film 114 applied to the housing 100. The film 114 includes a button 118 aligned with the first and second contacts 102, 104. A conductive material 120 is attached to a bottom surface of the button 118. When depressed a sufficient distance along a direction A, the conductive material 120 connects with the contact portions 110, 112 of the first and second contacts 102, 104 thereby establishing electrical connection therebetween.

However, when the film 114 is applied to the housing 100, the button 118 may not be accurately aligned with the contact portions 110, 112. Thus, the conductive material 120 may not establish a proper electrical connection between the first and second contacts 102, 104. In addition, the button 118 is made of plastic and will wear away after repeated depressions. Thus, the button 118 will eventually require replacement, which is inconvenient. Furthermore, since the conductive material 120 must be simultaneously connected with both contact portions 110, 112, the depression force exerted on the button 118 must be evenly applied to ensure a good electrical connection. Hence, an improved key switch assembly is requisite to overcome the disadvantages of the prior art.

BRIEF SUMMARY OF THE INVENTION

A main object of the present invention is to provide a key switch assembly which can be easily assembled.

Another object of the present invention is to provide a key switch assembly having a metal dome for contacting only one contact to implement electrical connection between two contacts thereby improving input reliability of the key switch assembly.

Accordingly, a key switch assembly of the present invention comprises a housing, first and second contacts, and a metal dome. The housing forms an aperture inwardly recessed from a side surface thereof. The first and second contacts are partially received in the housing and include first and second contact portions, first and second mounting portions for being mounted on the circuit board, and first and second connecting portions respectively connected between the first and second contact portions and the first and second mounting portions. The metal dome is securely received in the aperture of the housing and includes a base and a mating portion extending from the base. The mating portion contacts the first contact portion of the first contact and the base contacts the second contact portion of the second contact when the metal dome is depressed.

Other objects, advantages and novel features of the invention will become more apparent from the following detailed description when taken in conjunction with the accompanying drawings.

DETAILED DESCRIPTION OF THE INVENTION

Figure 1:
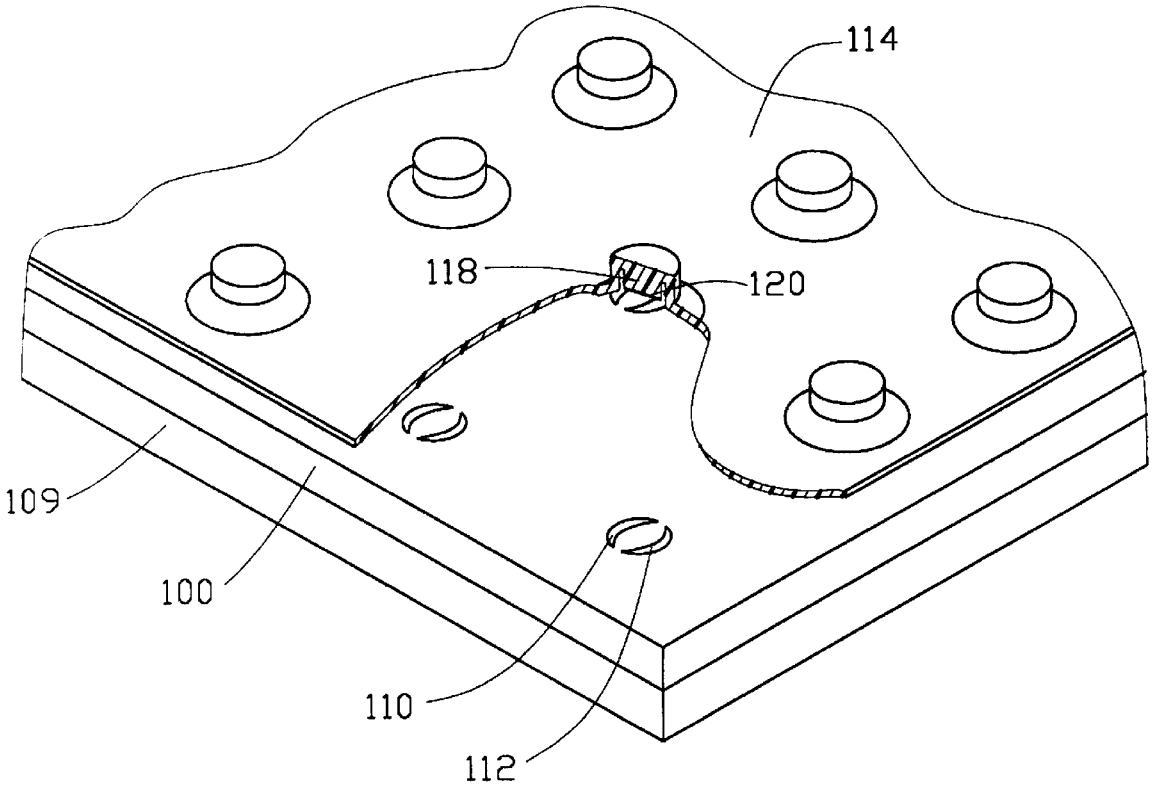
FIG. 1 (PRIOR ART)
FIG. 1 is a partially cut away perspective view of a conventional key switch assembly.
Figure 2:
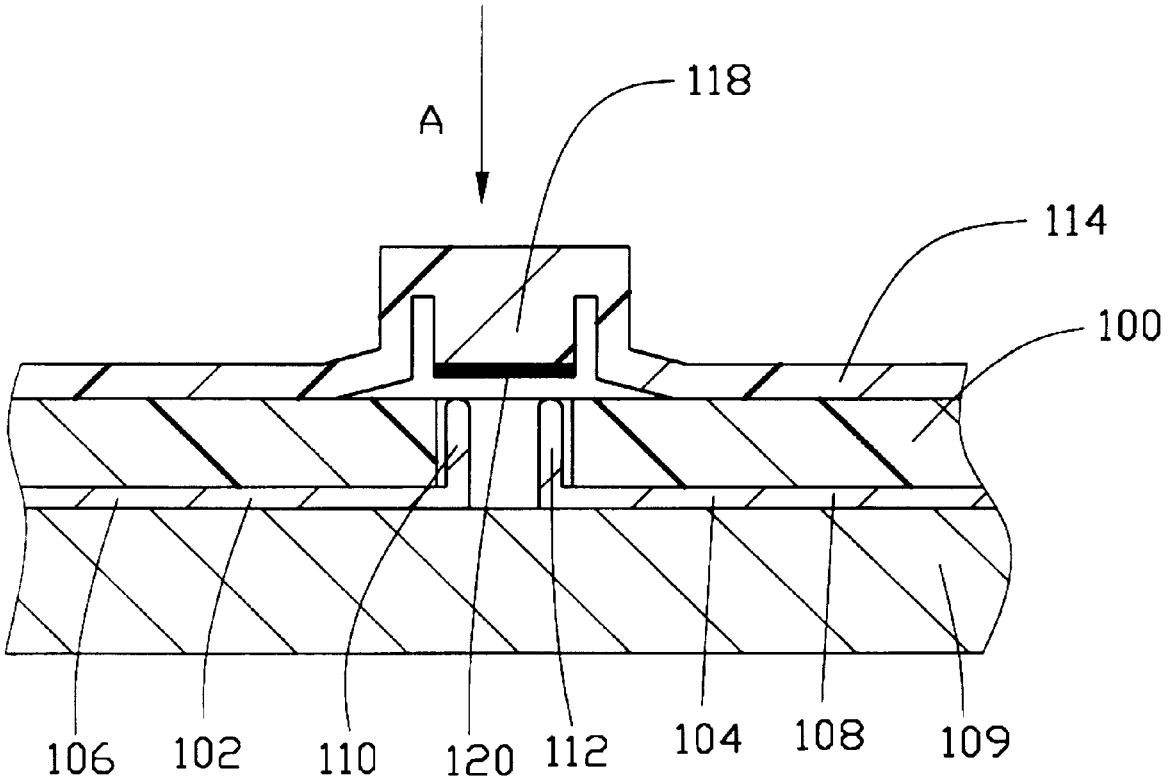
FIG. 2 (PRIOR ART)
FIG. 2 is a cross-sectional view of the conventional key switch assembly.
Figure 3:
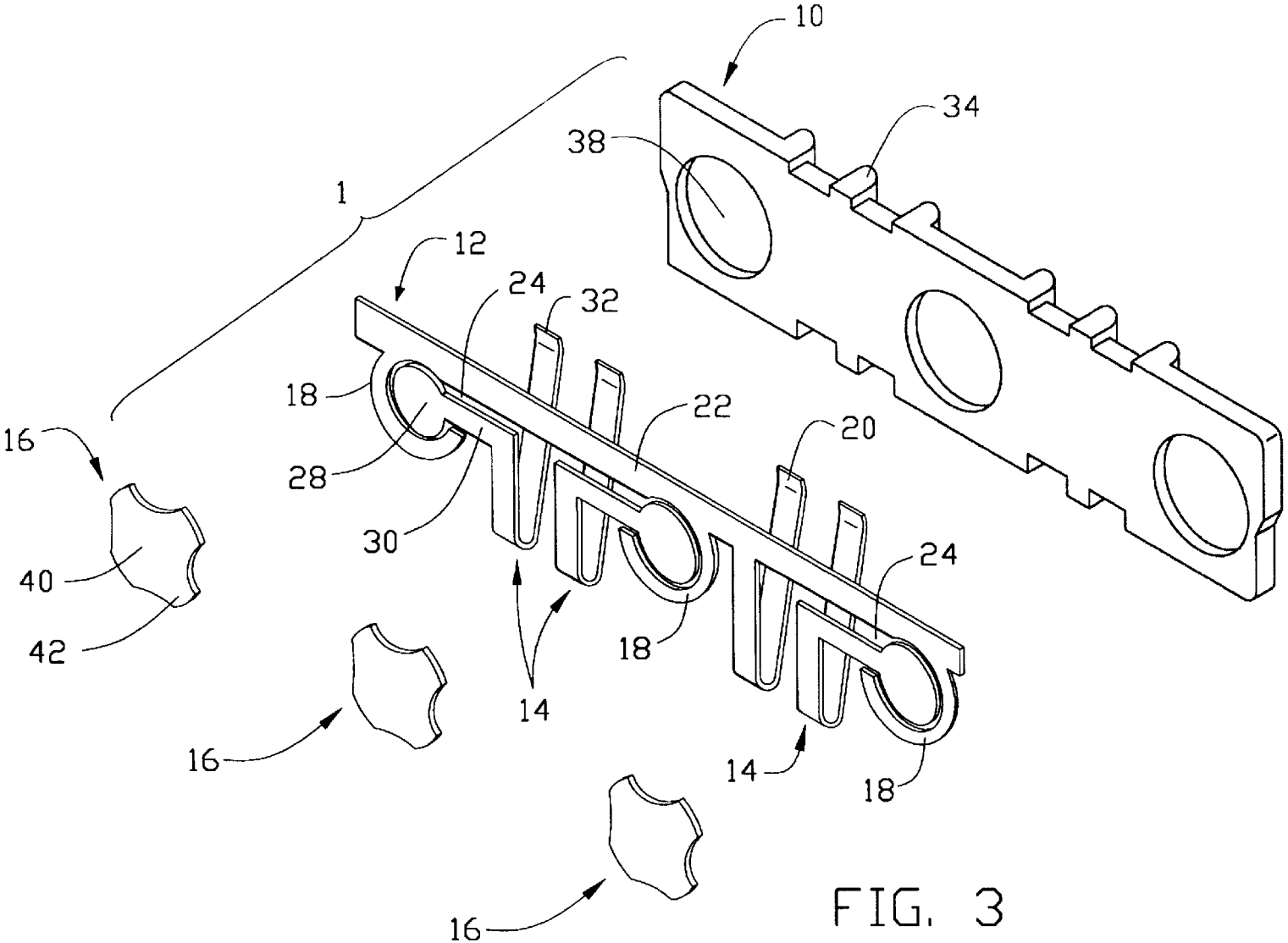
FIG. 3 is an exploded view of a key switch assembly of the present invention.
Figure 4:
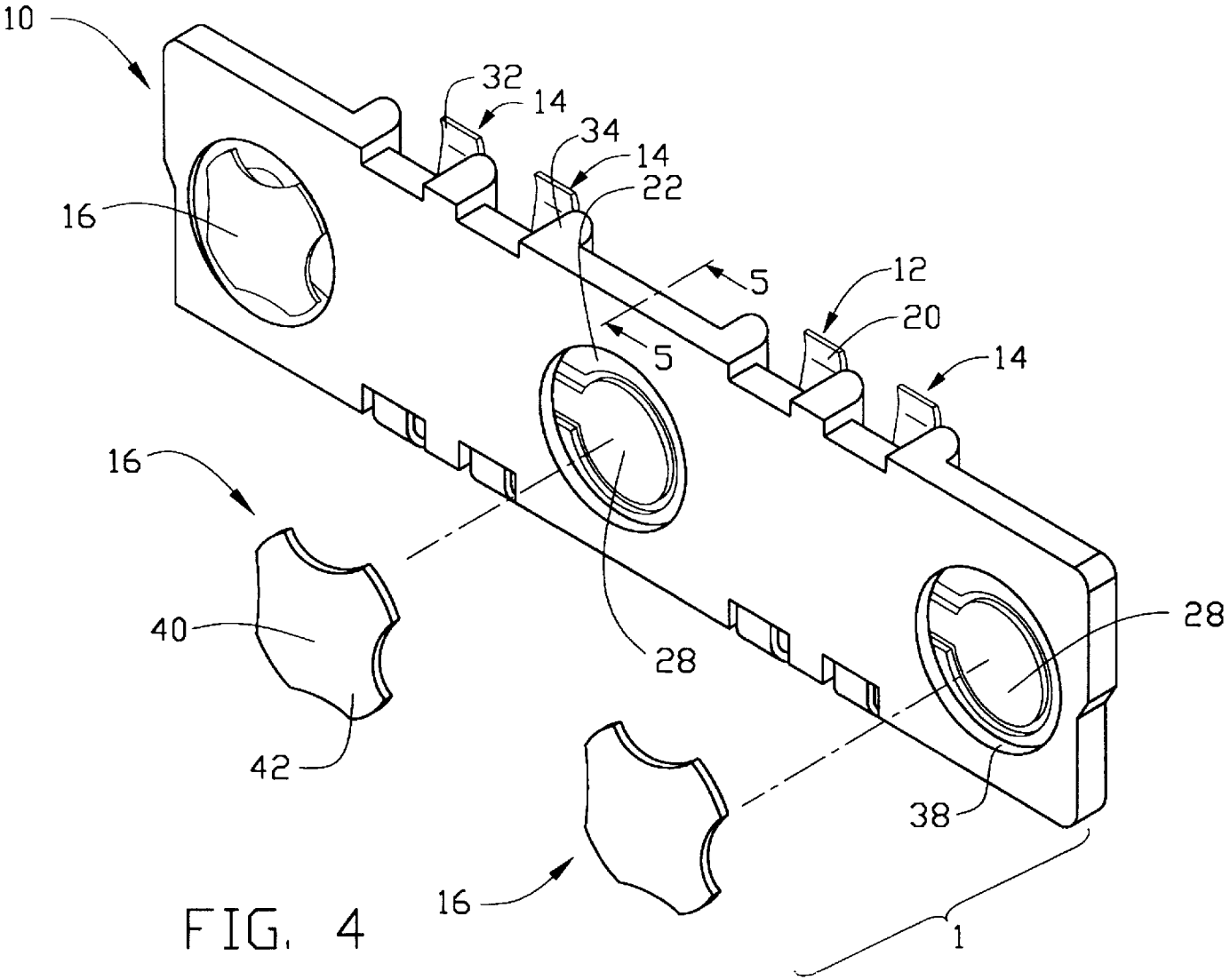
FIG. 4 is a partial assembled view of FIG. 3.
Figure 5:
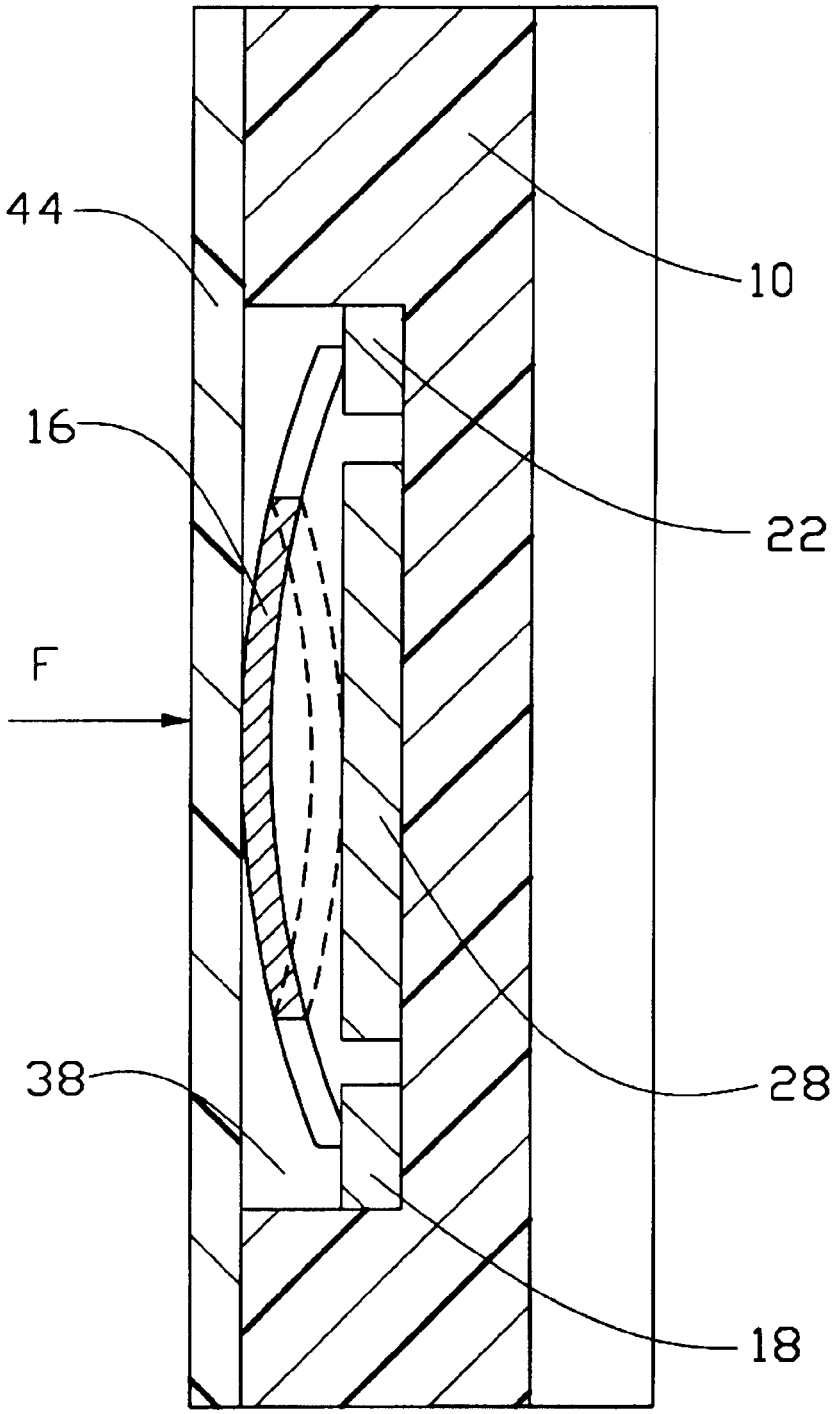
FIG. 5 is a cross-sectional view of the key switch of FIG. 4 taken along line 5—5.

Referring to FIGS. 3–5, a key switch assembly 1 in accordance with the present invention generally comprises a housing 10, a first contact 12, three second contacts 14 and three metal domes 16. The first contact 12 includes an elongate first connecting portion 22 and three ring-shaped first contact portions 18 extending from opposite ends and a central portion of the first connecting portion 22. A space 24 is defined between a distal end of each first contact portion 18 and the first connecting portion 22. A generally U-shaped first mounting portion 20 extends from the central portion of the first connecting portion 22 for being mounted on and electrically connecting with a printed circuit board (not shown).

Each second contact 14 comprises a circular second contact portion 28 surrounded by the first contact portion 18, a second connecting portion 30 extending from the second contact portion 28 through the space 24, and a generally U-shaped second mounting portion 32 perpendicularly extending from the second connecting portion 30. The second contact 14 does not contact the first contact 12. The first and second mounting portions 20, 32 are configured to be properly aligned after assembly.

The first and second contacts 12, 14 are integrated with the housing 10 by insert molding. The first and second connecting portions 22, 30 are generally enclosed by the housing 10. The first and second contact portions 18, 28, and the first and second mounting portions 20, 32 are generally exposed to an exterior of the housing 10. The housing 10 forms three round apertures 38 in a side surface thereof dimensioned to expose the first and second contact portions 18, 28. Three protrusions 34 are formed between each pair of adjacent apertures 38 on an edge of the housing 10 for correspondingly receiving a portion of the first and second mounting portions 20, 32 of the first and second contacts 12, 14 therebetween.

Each metal dome 16 is stamped from resilient metal and is accurately dimensioned to be received in the correspondingly aperture 38 of the housing 10. The metal dome 16 comprises a base 40 and four mating portions 42 equidistantly extending from outer edges of the base 40. The mating portions 42 are mounted on the first contact portions 18 and the first connecting portion 22 of the first contact 12 by conductive glue whereby the metal dome 16 maintains a stable electrical connection with the first contact 12. When depressed along a direction F, the base 40 contacts the second contact portion 28 of the second contact 14 (shown in dashed lines in FIG. 5) thereby implementing an electrical connection between the metal dome 16 and the second contact 14. Additionally, a sticky film 44 is applied to each metal dome 16 and the housing 10 for preventing the metal dome 16 from becoming misaligned with the corresponding aperture 38 of the housing 10.

Since the first and second contacts 12, 14 are integrated with the housing 10 by insertion molding, the assembly procedure is simplified. In addition, each metal dome 16 is easily assembled and accurately aligned with the corresponding aperture 38 of the housing 10. Furthermore, each metal dome 16 is made of resilient metal; it can endure repeated depressions.

Moreover, since each metal dome 16 maintains electrical connection with the first contact 12, to ensure proper electrical connection between the first contact 12 and the second contact 14, the metal dome 16 need only contact the second contact 14. Thus, good electrical connection is easily established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key switch assembly comprising:

a housing having at least one aperture inwardly recessed from a side surface thereof;

a first contact received in the housing and including a first contact portion exposed to each of the at least one aperture of the housing, a first mounting portion outwardly extending from the housing for mounting to a circuit board, and a first connecting portion connected between the first contact portion and the first mounting portion;

at least one second contact received in the housing and including a second contact portion exposed to the corresponding aperture of the housing, a second mounting portion outwardly extending from the housing for mounting to the circuit board, and a second connecting portion connected between the second contact portion and the second mounting portion; and a metal dome securely received in each aperture, including a base and a mating portion extending from the base, the mating portion connected with the first contact portion of the first contact through conductive glue, the base contacting the second contact portion of the second contact upon being depressed;

wherein the first contact portion of the first contact is ring-shaped, and the second contact portion of the second contact is circular and positioned within the first contact portion without contacting the first contact portion.

2. The key switch assembly as described in claim 1, wherein the first and second contacts are insert molded with the housing.

3. The key switch assembly as described in claim 1, wherein the housing forms a plurality of protrusions on an edge thereof for receiving a portion of the first and second mounting portions of the first and second contacts therebetween.

4. The key switch assembly as described in claim 1, wherein the first contact forms a space between the first contact portion and the first connecting portion for extension of the second connecting portion of the second contact therethrough without contacting the first contact.

5. The key switch assembly as described in claim 1, wherein the first mounting portion of the first contact and the second mounting portion of the second contact are aligned with each other in a line.

6. The key switch assembly as described in claim 1, wherein the metal dome comprises four mating portions equi-angularly extending from the base.

7. The key switch assembly as described in claim 6, wherein a sticky film is applied to the metal dome and the housing.

8. A key switch assembly comprising:

a housing defining an aperture therein;

a first contact received within the housing, said first contact including an elongate first connection portion, a first contact portion extending from the first connection portion, having a free end spaced from the first connection portion and disposed around the aperture, and a first mounting portion extending from the first connection portion and outward from the housing to a circuit board;

a second contact received within the housing, said second contact including a second contact portion disposed around the aperture, a second mounting portion extending outward from the housing to the circuit board, and a second connection portion connecting the second contact portion and the second mounting portion and extending between the free end of the first contact portion and the first connection portion; and a metal dome received within the aperture, said metal dome including a base and a mating portion; wherein said first contact portion surrounds the second contact portion, said mating portion surrounds the base, and said mating portion consistently mechanically and electrically engages the first contact portion while the base mechanically and electrically engages the second contact portion only when said metal dome is depressed.

9. A key switch assembly comprising:

a housing defining a plurality of apertures therein;

a first contact received within the housing, said first contact including a plurality of first contact portions respectively disposed around the corresponding apertures, a first mounting portion extending outward from the housing to a circuit board, and an elongated first connecting portion connected between said first mounting portion and said first contact portions;

a plurality of second contacts received within the housing, each of said second contacts including a second contact portion disposed around the corresponding aperture, a second mounting portion extending outward from the housing to the circuit board, and a second connecting portion connected between said second mounting portion and said second contact portion; and a metal dome received within each of the apertures; wherein said dome consistently mechanically and electrically engages only the first contact portion and further mechanically and electrically engages said second contact portion only when depressed, the first contact portion substantially surrounding the second contact portion.

* * * * *